United States Patent [19]

Vandevier et al.

[11] Patent Number: 4,749,034

[45] Date of Patent: Jun. 7, 1988

[54] FLUID MIXING APPARATUS FOR SUBMERSIBLE PUMPS

[75] Inventors: Joseph E. Vandevier; Lawrence E. Doty, both of Claremore, Okla.

[73] Assignee: Hughes Tool Company, Houston, Tex.

[21] Appl. No.: 67,521

[22] Filed: Jun. 26, 1987

[51] Int. Cl.[4] ..... E21B 43/12

[52] U.S. Cl. ..... 166/105; 166/68; 166/369; 417/65

[58] Field of Search ..... 166/105, 105.1, 68, 166/371, 369; 137/13; 417/54, 65

[56] References Cited

U.S. PATENT DOCUMENTS

| | | | |
|---|---|---|---|
| 1,432,425 | 10/1922 | Symons . | |
| 3,941,510 | 3/1976 | Morgan | 166/68 |
| 4,088,459 | 5/1978 | Tuzson | 55/203 |
| 4,310,288 | 1/1982 | Erickson | 417/54 |
| 4,386,653 | 6/1983 | Drake | 166/105 |
| 4,580,634 | 4/1986 | Cruise | 166/105 |
| 4,605,069 | 8/1986 | McClaflin et al. | 166/68 |

*Primary Examiner*—Stephen J. Novosad
*Assistant Examiner*—Terry L. Melius
*Attorney, Agent, or Firm*—James E. Bradley

[57] ABSTRACT

A well pump assembly has a tube extending into the well for delivering water to a point below the pump to reduce the viscosity of the oil being pumped. The downhole motor that drives the pump is surrounded by a jacket. The tube that delivers the water extends to a point below the jacket to a cross-over member mounted to the lower end of the jacket, which directs the water upward and inward. The cross-over member also has passages that directs the production fluid upward and outward.

3 Claims, 4 Drawing Sheets

FLUID MIXING APPARATUS FOR SUBMERSIBLE PUMPS

BACKGROUND OF THE INVENTION

1. Field of the Invention

This invention relates in general to electrical submersible pumps used in oil wells, and in particular to assembly for mixing another fluid downhole with the oil being produced to reduce viscosity at the pump intake.

2. Description of the Prior Art

A typical submersible pump assembly has a centrifugal pump located on the lower end of a string of tubing in the well casing. An electrical motor is located below the pump for rotating the pump. Fluid is drawn in the intake of the pump, which is on the lower end, and pumped through the tubing to the surface.

These types of pumps are often used in wells that have a high water to oil ratio, and thus require large volumes of fluid to be produced. In certain areas, oil wells exist that do not have a high water to oil ratio, but produce oil with high viscosity. In a centrifugal submersible pump, the efficiency declines with viscosity. As a result, other types of pumps and techniques have been employed to product highly viscous crude wells.

SUMMARY OF THE INVENTION

In this invention, a cutting fluid such as water is pumped down a tube into the well below the intake to reduce the viscosity of the crude. A single shroud extends from a point above the intake of the pump to a point below the motor. The cutting fluid tube extends alongside the motor and has an inlet in the shroud at the bottom. A cross-over member is mounted to the lower end of the shroud. The cross-over member has passages for both the oil and the cutting fluid. One of the passages directs the oil upward and outward. The other passage directs the cutting fluid upward and inward, causing the paths of the fluid and oil to cross and combine above the cross-over member.

DESCRIPTION OF THE PREFERRED EMBODIMENT

Figure 1A:
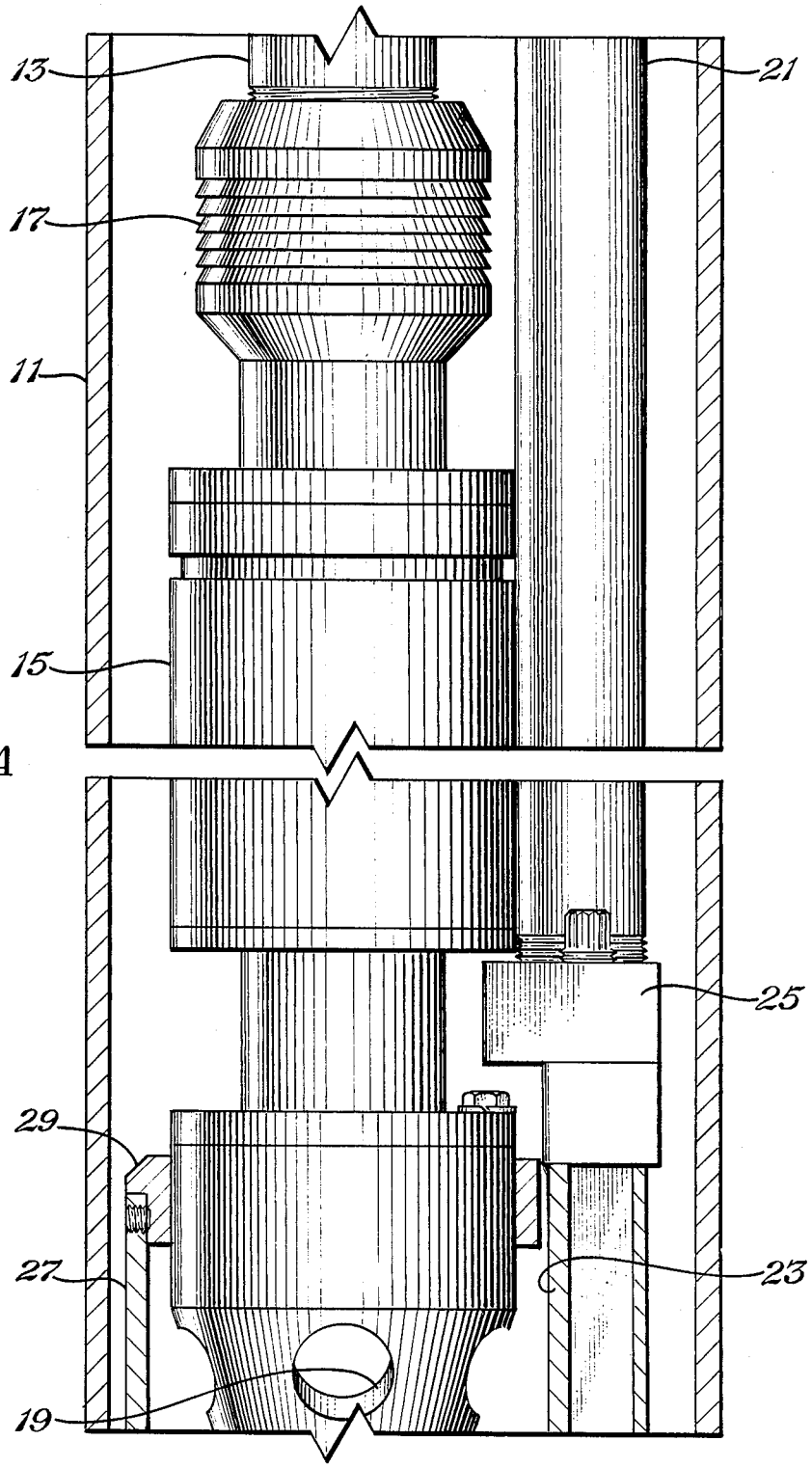
FIGS. 1A, 1B and 1C are views, partially in vertical section, illustrating a well pump assembly constructed in accordance with this invention.

Referring to FIG. 1A, the well contains casing 11. A string of tubing 13 extends from the surface to a centrifugal pump 15. Pump 15 is of a conventional type having a number of stages of impellers and diffusers (not shown) for pumping fluid through the tubing 13 to the surface. Pump 15 is connected through a discharge head coupling 17 to this tubing 13 for discharging all of the fluid from pump 15 through the tubing 13 to the surface. Pump 15 has an intake 19 on its lower end.

A small pipe or cutting fluid conduit 21 extends from the surface along the side of the tubing 13. The axis of the pipe 21 is parallel to the axis of the tubing 13. At the surface, a pump (not shown) pumps cutting fluid, such as water, down the pipe 21 to lower the viscosity at the intake 19 of the submersible pump 15.

Figure 2:
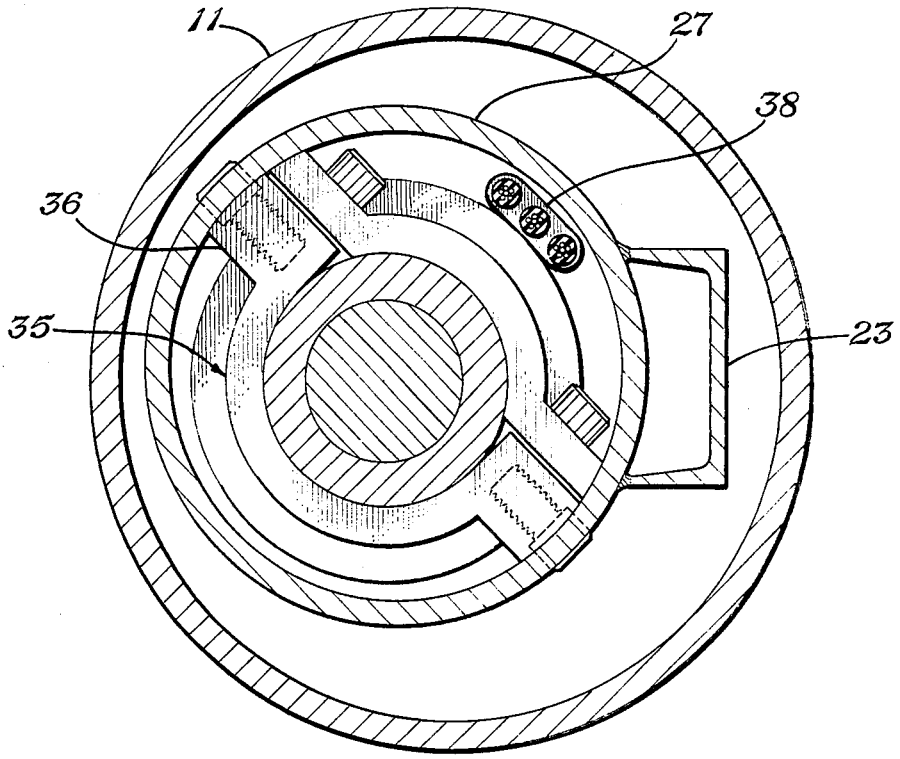
FIG. 2 is a sectional view of the pump assembly of FIG. 1, taken along the line II—II of FIG. 1B.

Pipe 21 joins a cutting fluid conduit 23 at a point a short distance above the intake 19 of the pump 15. An adapter 25 is located at the junction between the pipe 21 and the conduit 23. As shown in FIG. 2, conduit 23 is rectangular in cross-section and has a width that is wider than its radial thickness. Conduit 23 has three rectangular walls and is welded to a shroud or cylindrical jacket 27. The inner wall of conduit 23 is formed by the jacket 27.

Referring again to FIG. 1A, jacket 27 is secured at the upper end to a flange 29, which in turn is secured to the pump 15 just above the intake 19. Flange 29 substantially seals fluid in the annulus above the intake 19 from flowing into the jacket 27 at the top.

Figure 1B:
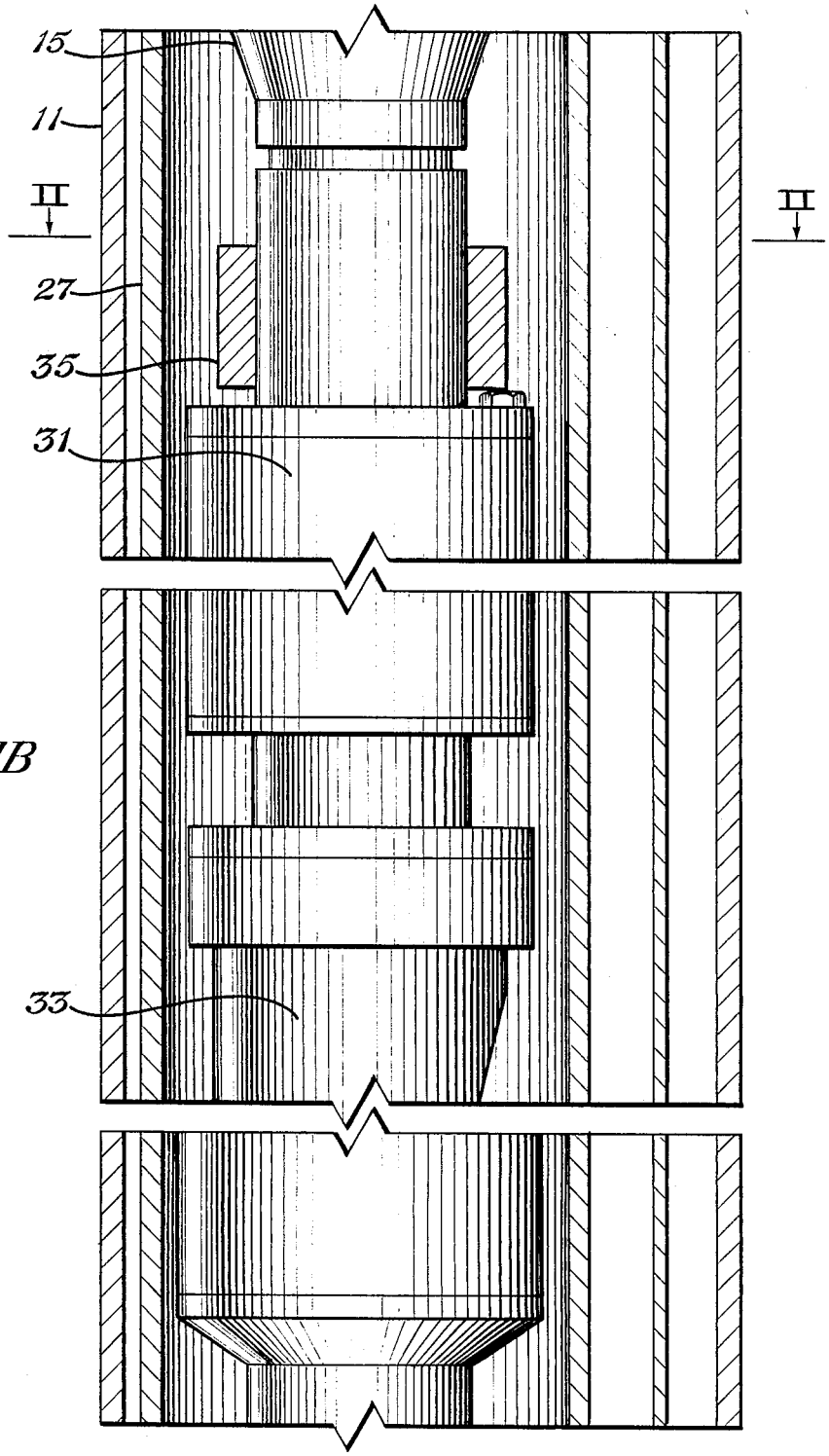

Referring to FIG. 1B, a seal section 31 is connected to the bottom of the pump 15 and is enclosed within the jacket 27. Seal section 31 is a conventional element used with submersible pumps. Seal section 31 is connected on its lower end to an electrical motor 33. The shaft (not shown) of the motor 33 extends through the seal section 31 and is coupled to the shaft (not shown) inside the pump 15 for driving the pump. Seals (not shown) located in the seal section 31 seal the shaft of the motor and prevent the entry of well fluid into the motor 33.

A jacket support 35 is mounted to the bottom of the pump 15. As shown in FIG. 2, the jacket support 35 is clamped to the assembly above the motor and has lugs 36 that extend out and bear against the sidewall of the jacket 27. The lugs 36 are not shown in the sectional view of FIG. 1B. A power cable 38 extends through a slot (not shown) in the flange 29 (FIG. 1A). The power cable 38 extends into the top of the motor 33 for supplying electrical power. The lugs 36 allow the free passage of fluid past the jacket support 35 to the intake 19 (FIG. 1A).

Figure 1C:
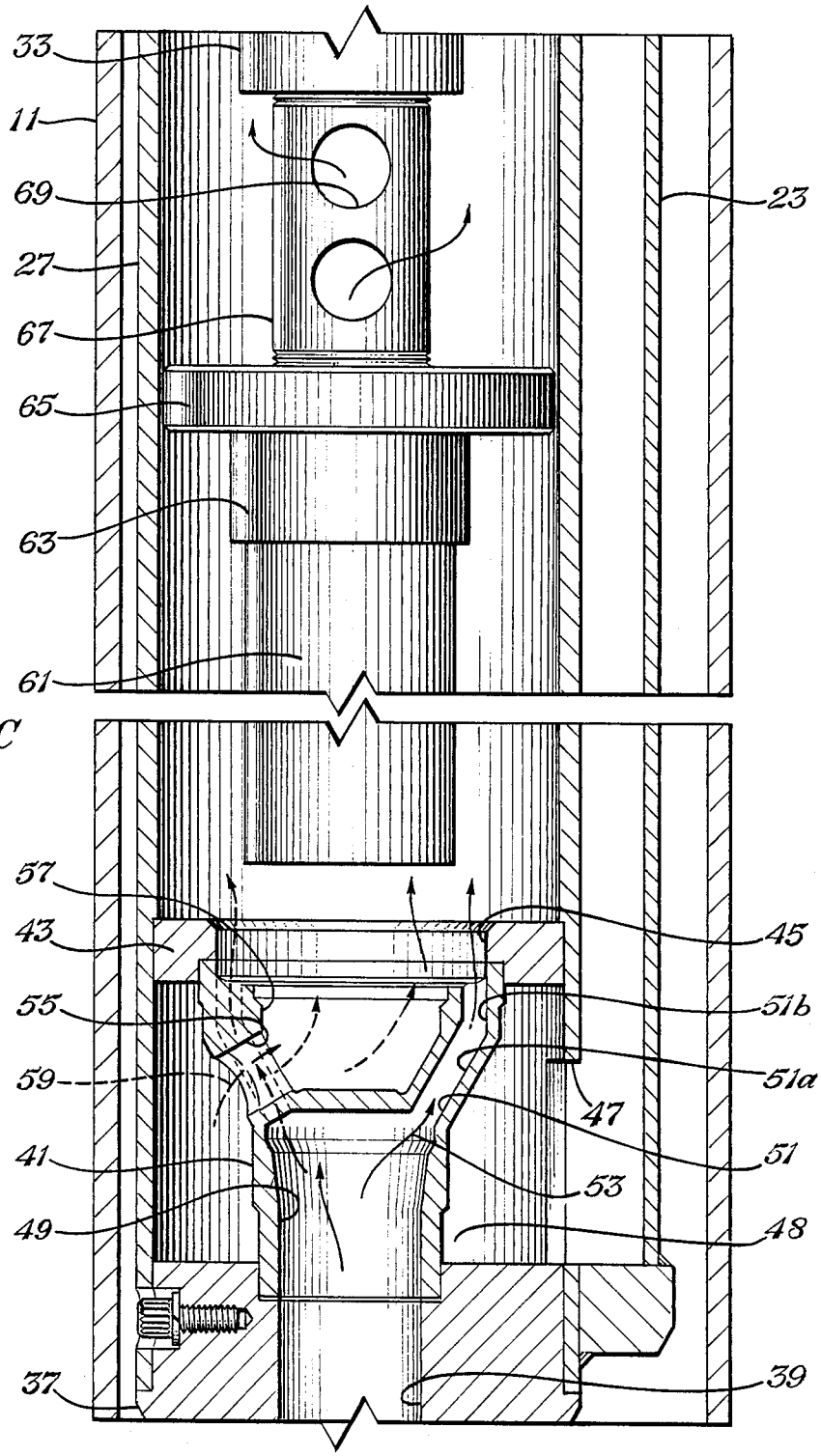

Referring to FIG. 1C, a lower partition 37 is secured to the lower end of the jacket 27, which is below the bottom of motor 33. Partition 37 is a solid plate that blocks the entry of fluid into the jacket 27, except through an axial passage 39. The axis of passage 39 coincides with the axis of the motor 33.

A cross-over member 41 is secured to the lower partition 37, and extends upward from it. The cross-over member 41 fits within a counterbore at the upper end of the passage 39. The upper end of cross-over member 41 is secured to an upper partition 43. Upper partition 43 is sealingly secured in the jacket 27 and has an axial passage 45 to which the cross-over member 41 joins. The lower end of cutting fluid conduit 23 joins a port 47 formed in the wall of jacket 27. The partitions 37 and 43 define a chamber 48 surrounding the cross-over member 41 for receiving cutting fluid through the port 47.

The cross-over member 41 has an axial production fluid inlet 49 that is coaxial with the lower partition passage 39. Production fluid inlet 49 is cylindrical in its lower portion, and flares outward slightly in its upper portion.

Four production fluid passages 51 (only one shown in solid lines) extend from the upper end of the production fluid inlet 49. The production fluid passages 51 are spaced around the axis of the cross-over member 41. Each production fluid passage 51 has a straight lower portion **51*a* that inclines outward at an angle of about 60 degrees. The lower portion 51*a* joins an upper portion 51*b* that is vertical, having an axis that is parallel with the cross-over member axis 41. The upper end of each upper portion 51*b* is spaced a greater radial distance from the axis of the cross-over member 41 than the lower end of the lower portion 51*a*. Neither passage portion 51*a* nor 51*b* inclines in a spiral fashion, rather the axes of both portions 51***a* and 51*b* are contained in the same plane as the axis of the cross-over member 41. As shown by the arrows 53, the production fluid or crude from the well passes through the production fluid inlet 49 and into each production fluid passage 51, discharging outward from passage 45.

Two cutting fluid passages 55 (only one shown) are located in the sidewall of the cross-over member 41 above the production fluid inlet 49. Each cutting fluid passage 55 is spaced 180 degrees apart from the other, and spaced between the production fluid passages 51. The cutting fluid passages 55 lead from the chamber 48 into a cavity 57 located at the top of the cross-over member 41. Each cutting fluid passage 55 is inclined at an angle of about 60 degrees. The upper end of each cutting fluid passage 55 is spaced closer to the axis of the cross-over member 41 than the lower end of the cutting fluid passage 55. The cutting fluid passages 55 do not incline in a spiral fashion, rather the axis of each cutting fluid passage 55 is contained within a vertical plane that passes also through the axis of the cross-over member 41. As shown by the arrows 59, cutting fluid pumped through the cutting fluid conduit 23 enters the chamber 48, and flows inwardly into the cavity 57 and out the top where it mixes with the production fluid discharged from the production fluid passages 51.

A static diffuser 61 is mounted above the cross-over member 41 for receiving all of the fluids discharged from the passages 51 and 55. The static diffuser 61 is a conventional element, having a plurality of baffles or plates (not shown) located in its interior. These plates, are positioned to enhance mixing of the production fluid and the cutting fluid. The static diffuser 61 is connected by an adapter 63 to a plate 65. Plate 65 extends out to essentially seal against the inner diameter of the jacket 27. Plate 65 forces substantially all of the fluid to flow through the static diffuser 61, rather than around the plate 65. Plate 65 is secured to a nipple 67 that is secured to the bottom of the motor 33. Nipple 67 has a pair of apertures 69, out of which fluid discharged from the static diffuser 61 passes.

In operation, electrical power from the surface is supplied over the power cable 38 to the motor 33. The motor 33 rotates to drive the pump 15. Cutting fluid such as water is pumped down the pipe 21, to flow through the conduit 23 into the chamber 48, as shown in FIG. 1C. The suction of the pump 15 draws in production fluid through the production fluid intake 49, as shown by the arrows 53. The production fluid flows upward and outward through the production fluid passages 51 to discharge from the cross-over member 41. The cutting fluid flows from the chamber 48 into the cutting fluid passages 55, as shown by arrows 59, to discharge from the cross-over member 41.

The change in flow paths of the cutting fluid and the production fluid causes them to mix and combine as they enter the static diffuser 61. Further mixing of the fluids occur in the static diffuser 61. The mixing of the fluids causes the viscosity to reduce, because the cutting fluid will be at a much lower viscosity than the production fluid. The reduced viscosity fluid mixture passes upward through the jacket 27 and is drawn into the intake 19 (FIG. 1A) of the pump 15. Pump 15 pumps the mixture to the surface through the tubing 13. At the surface, the cutting fluid will be separated from the production fluid and reinjected down the pipe 21.

The invention has significant advantages. The cross-over member enhances the ability of the static diffuser to mix the fluids by premixing the fluids prior to entering into the static diffuser. The cross-over member is simple in construction.

While the invention has been shown in only one of its forms, it should be apparent to those skilled in the art that it is not so limited, but is susceptible to various changes without departing from the scope of the invention.

We claim:

1. A well pump assembly for pumping production fluid, comprising in combination:

a centrifugal submersible pump having an intake on its lower end and adapted to be secured to a string of tubing;

an electrical motor located below the pump for driving the pump;

a jacket enclosing the pump intake and motor, extending from above the intake to a point below the motor and adapted to extend into the production fluid;

a cutting fluid conduit adapted to extend from the surface for delivering a cutting fluid from the surface, the cutting fluid conduit terminating below the motor and in fluid communication with a cross-over member;

said cross-over member mounted to the lower end of the jacket below the motor;

cutting fluid passage means in the cross-over member for receiving the cutting fluid from the cutting fluid conduit and for directing the cutting fluid upward;

production fluid passage means in the cross-over member adapted to be in communication with the production fluid for directing the production fluid upward, the cutting fluid passage means and the production fluid passage means crossing each other, with one of the passage means leading upward and outward and the other leading upward and inward, causing the fluids to mix above the cross-over member to facilitate pumping of the production fluid when highly viscous.

2. A well pump for pumping production fluid, comprising in combination:

a centrifugal submersible pump having an intake on its lower end and adapted to be secured to a string of tubing;

an electrical motor located above the pump for driving the pump;

a jacket enclosing the pump intake and motor, extending from above the intake to a point below the motor;

a cutting fluid conduit adapted to extend from the surface for delivering a cutting fluid from the surface, the cutting fluid conduit being offset from and parallel to the axis of the jacket, the cutting fluid conduit terminating below the motor;

a cutting fluid chamber located at the lower end of the jacket below the motor in communication with the lower end of the cutting fluid conduit;

a cross-over member mounted in the chamber;

production fluid passage means in the cross-over member adapted to be in communication with production fluid outside the chamber for directing production fluid upward; and cutting fluid passage means in the cross-over member in communication with the cutting fluid in the chamber for directing cutting fluid upward, the cutting fluid passage means and the production fluid passage means crossing each other, with one of the passage means leading upward and outward and the other leading upward and inward, causing the fluids to mix with each other above the cross-over member to facilitate pumping of the production fluid when highly viscous.

3. A well pump for pumping production fluid, comprising in combination:

a centrifugal submersible pump having an intake on its lower end and adapted to be secured to a string of tubing;

an electrical motor located above the pump for driving the pump;

a jacket enclosing the pump intake and motor, extending from above the intake to a point below the motor;

a pair of partitions secured in the jacket below the motor, each having an aperture therethrough;

a cross-over member mounted between the partitions, having an upper end registering with the aperture in the upper partition and a lower end registering with the aperture in the lower partition, defining a chamber surrounding the cross-over member and between the partitions;

a cutting fluid conduit adapted to extend from the surface for delivering a cutting fluid from the surface, the cutting fluid conduit being offset from the axis of the jacket, secured to the exterior of the jacket and terminating below the motor in the chamber;

a plurality of production fluid passages in the cross-over member, each extending upward from the aperture in the lower partition for directing production fluid upward, one end of each production fluid passage being spaced a greater radial distance from the axis of the motor than the other end of each production fluid passage; and a cutting fluid passage in the cross-over member in communication with the chamber and extending upward for directing cutting fluid upward, one end of the cutting fluid passage being located a greater radial distance from the axis of the motor than the other end of the cutting fluid passage, to cause the fluids to mix above the cross-over member.

* * * * *